US009837056B1

(12) United States Patent
Davis

(10) Patent No.: US 9,837,056 B1
(45) Date of Patent: Dec. 5, 2017

(54) GUITAR PICK HOLDER

(71) Applicant: Andrew Davis, Pipe Creek, TX (US)

(72) Inventor: Andrew Davis, Pipe Creek, TX (US)

( * ) Notice: Subject to any disclaimer, the term of this patent is extended or adjusted under 35 U.S.C. 154(b) by 0 days.

(21) Appl. No.: 15/695,075

(22) Filed: Sep. 5, 2017

(51) Int. Cl.
*G10D 3/16* (2006.01)

(52) U.S. Cl.
CPC ..... *G10D 3/163* (2013.01)

(58) Field of Classification Search
CPC ..... G10D 3/163; G10D 3/08
See application file for complete search history.

(56) References Cited

U.S. PATENT DOCUMENTS

| | | | | |
|---|---|---|---|---|
| 6,054,643 | A | 4/2000 | Chance | |
| 6,215,052 | B1 * | 4/2001 | Giddens | G10D 3/163 211/120 |
| 6,891,095 | B2 | 5/2005 | Charters | |
| 8,178,767 | B1 | 5/2012 | King | |
| D707,287 | S | 6/2014 | Thomas | |
| 9,418,633 | B1 | 8/2016 | Storck | |
| 2015/0255050 | A1 | 9/2015 | Lopez | |

FOREIGN PATENT DOCUMENTS

| | | | |
|---|---|---|---|
| WO | 2008094908 | A | 8/2008 |

* cited by examiner

*Primary Examiner* — Kimberly Lockett

(57) ABSTRACT

The guitar pick holder is configured for use with a stringed musical instrument. The guitar pick holder handle holds and controls one or more plectrum. The guitar pick holder allows the one or more plectrum to be used simultaneously. The guitar pick holder: 1) enables the simultaneous plucking of two or more strings selected from the plurality of strings by a plurality of plectrum; 2) enables the simultaneous plucking of a single string selected from the plurality of strings by a plurality of plectrum; and 3) enables the simultaneous plucking of two or more strings by a plurality of coins. The guitar pick holder comprises a hand grip, one or more plectrum slots, and one or more reverb slots. The one or more plectrum slots and the one or more reverb slots are formed within the hand grip.

20 Claims, 8 Drawing Sheets

GUITAR PICK HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of musical instruments including stringed musical instruments, more specifically, a plectrum holder configured for use with a plurality of picks.

SUMMARY OF INVENTION

The guitar pick holder is configured for use with a stringed musical instrument. The guitar pick holder handle holds and controls one or more plectrum. The guitar pick holder allows the one or more plectrum to be used simultaneously. The guitar pick holder: 1) enables the simultaneous plucking of two or more strings selected from the plurality of strings by a plurality of plectrum; 2) enables the simultaneous plucking of a single string selected from the plurality of strings by a plurality of plectrum; and 3) enables the simultaneous plucking of two or more strings by a plurality of coins. The guitar pick holder comprises a hand grip, one or more plectrum slots, and one or more reverb slots. The one or more plectrum slots and the one or more reverb slots are formed within the hand grip.

These together with additional objects, features and advantages of the guitar pick holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the guitar pick holder in detail, it is to be understood that the guitar pick holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the guitar pick holder.

It is therefore important that the claims be regarded as including such equivalent construction insofar as they do not depart from the spirit and scope of the guitar pick holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
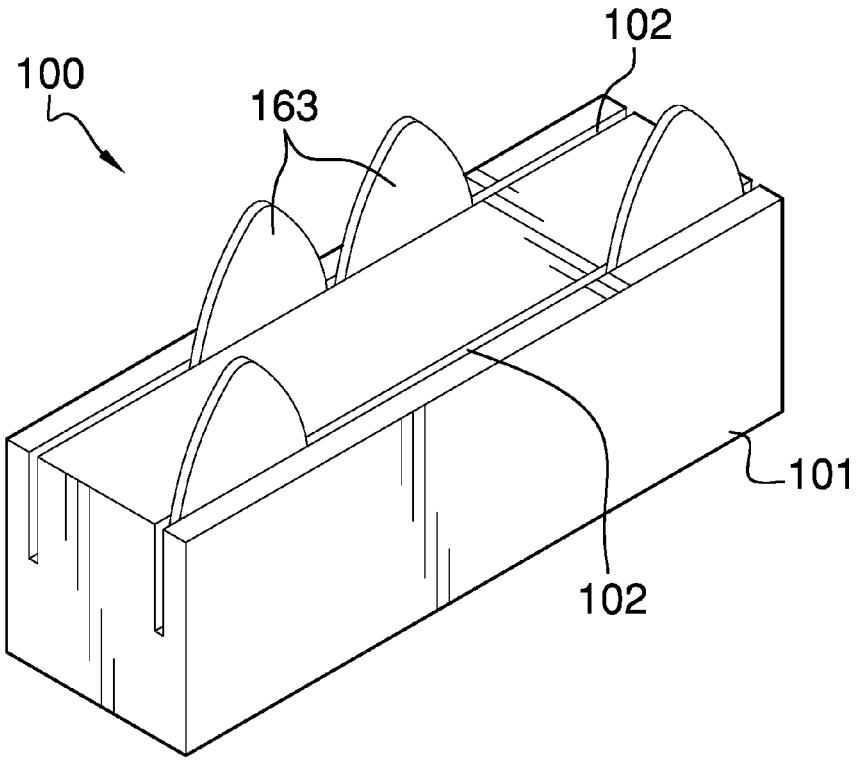
FIG. 1 is a perspective view of an embodiment of the disclosure.
Figure 2:
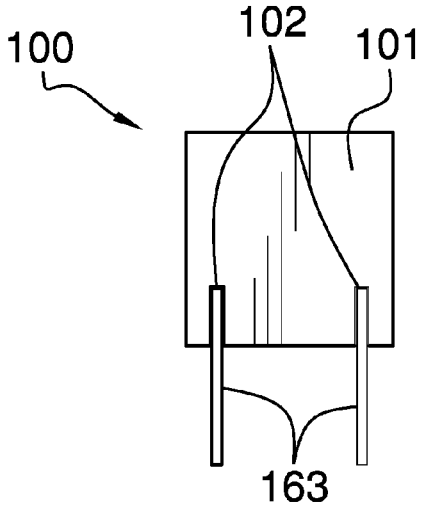
FIG. 2 is a side view of an embodiment of the disclosure.
Figure 3:
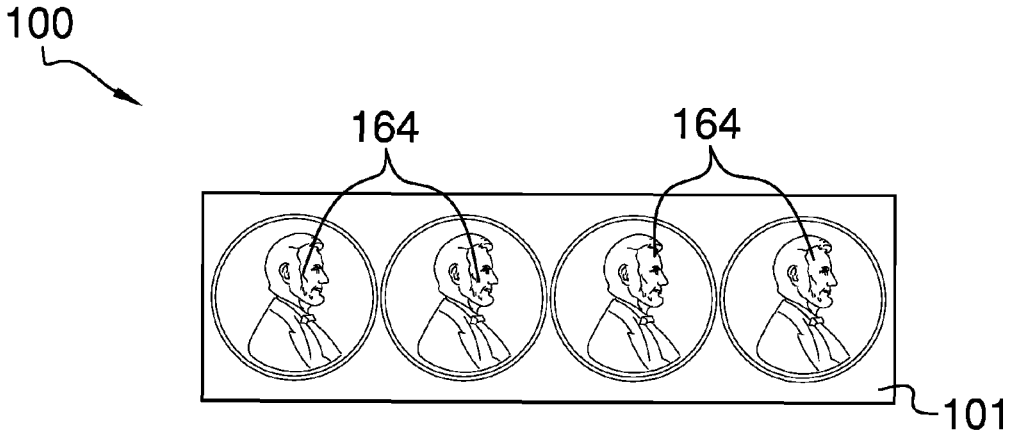
FIG. 3 is a top view of an embodiment of the disclosure.
Figure 4:
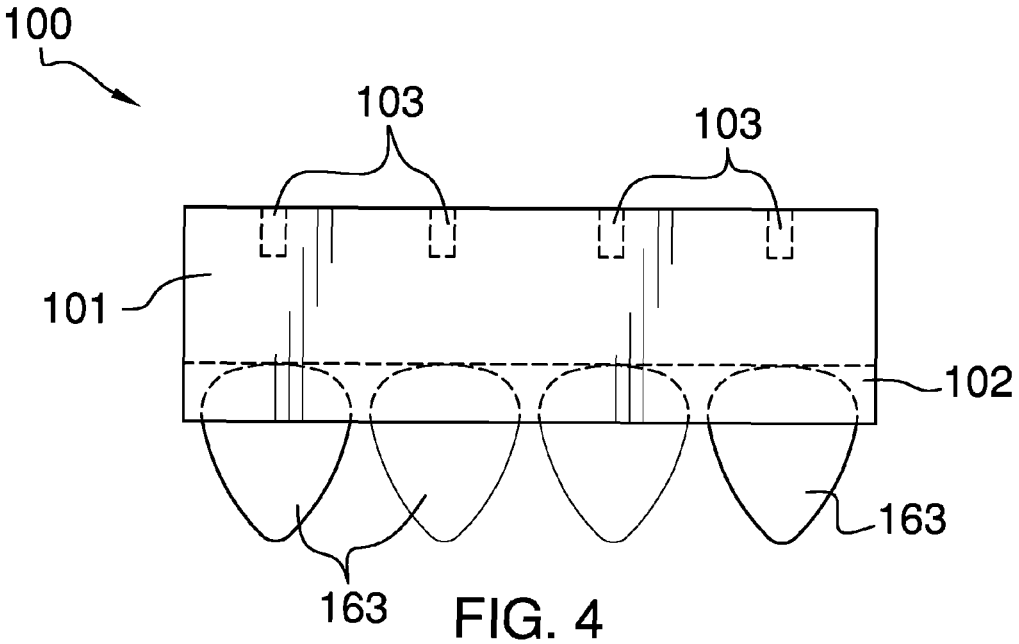
FIG. 4 is a front view of an embodiment of the disclosure.
Figure 5:
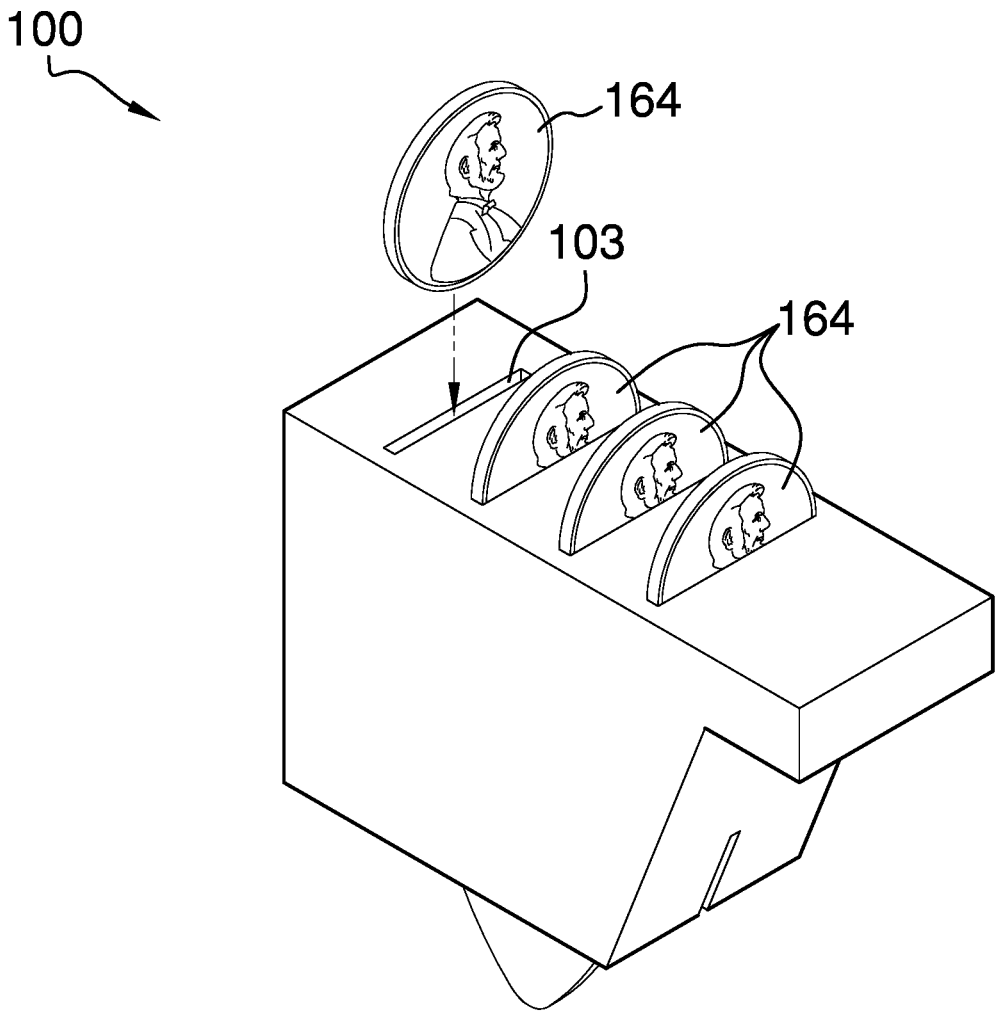
FIG. 5 is a reverse perspective view of an embodiment of the disclosure.
Figure 6:
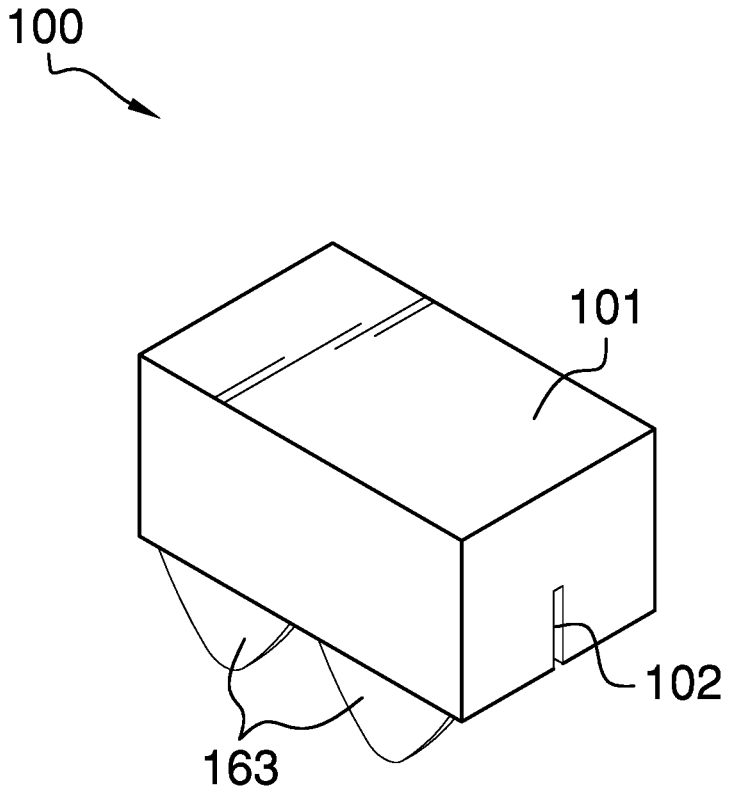
FIG. 6 is a perspective view of an alternate embodiment of the disclosure.
Figure 7:
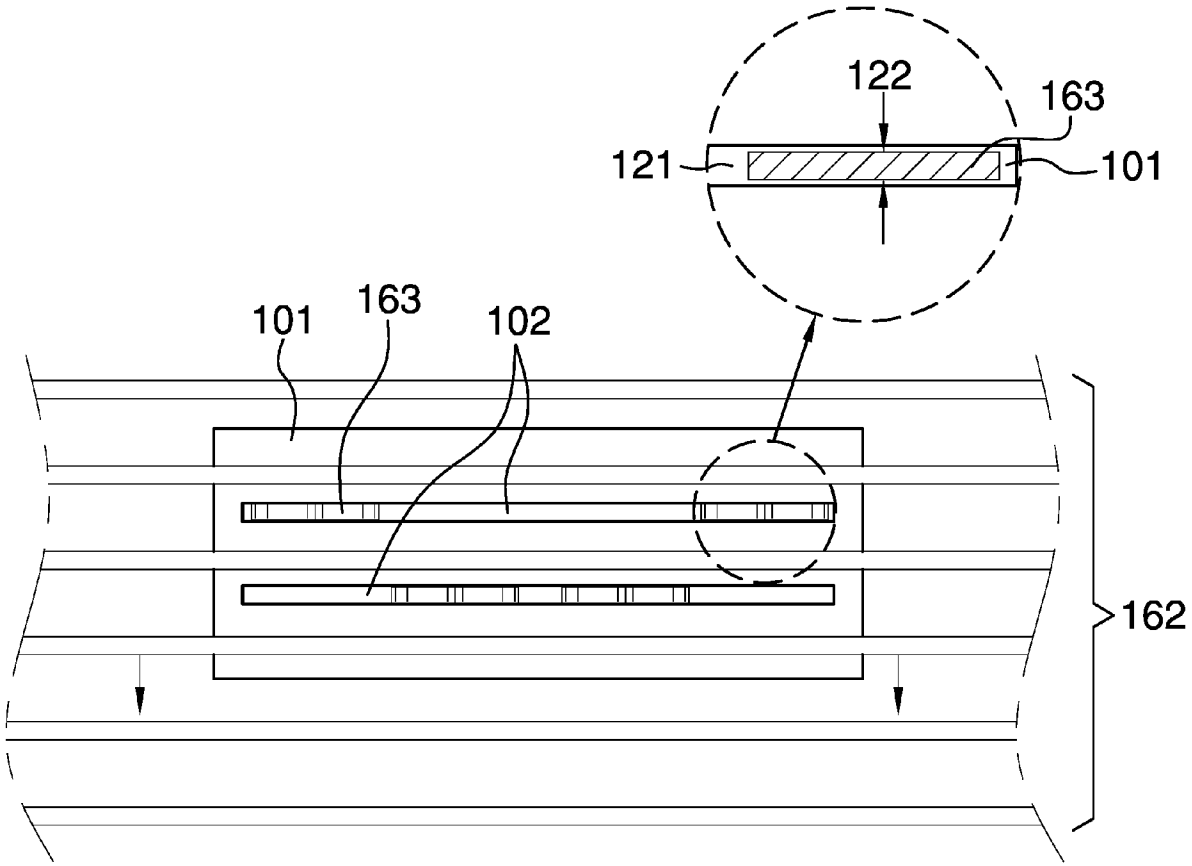
FIG. 7 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 10.

The guitar pick holder 100 (hereinafter invention) is an accessory configured for use with a stringed musical instrument 161. Examples of stringed musical instrument 161s suitable for use with the invention 100 include, but are not limited to, a guitar, a bass guitar, a lyre, a sitar, a veena, an oud, a mandolin, a pipa, a Zhongruan, and a harp. The stringed musical instrument 161 further comprises a plurality of strings 162. The assumption within this disclosure is that it is desirable that the stringed musical instrument 161 be played with one or more accessories selected from the group consisting of one or more plectrum 163 and one or more coins 164. The invention 100 is a handle that holds and controls one or more plectrum 163. The plectrum is used to play the stringed musical instrument 161. The invention 100 allows the one or more plectrum 163 and the one or more coins 164 to be used simultaneously on the stringed musical instrument 161.

More specifically, the invention 100: 1) enables the simultaneous plucking of two or more strings selected from the plurality of strings 162 by two or more plectrum selected from the one or more plectrum 163; 2) enables the simultaneous plucking of a single string selected from the plurality of strings 162 by two or more plectrum selected from the one or more plectrum 163; and 3) enables the simultaneous plucking of two or more strings by two or more coins selected from the one or more coins 164 to create a distinctive reverberation effect from the stringed musical instrument 161. The invention 100 comprises a hand grip 101, one or more plectrum slots 102, and one or more reverb slots 103. The one or more plectrum slots and the one or more reverb slots 103 are formed within the hand grip 101.

Each of the plurality of strings 162 is a cord like structure that is attached to the stringed musical instrument 161. The tension on the each of the plurality of strings 162 is adjusted such that each of the plurality of strings 162 will vibrate at a predetermined frequency when the selected string is plucked. Each of the one or more plectrum 163 is a device that is used to pluck a string selected from the plurality of strings 162. Each of the one or more coins 164 is a coin used as currency. Any coin selected from the one or more coins 164 is used initiate a reverberation effect from a string selected from the plurality of strings 162. The reverberation effect occurs from the one or more reverb slots 103 and removing a selected one of the one or more coins 164 in order to change the sound of the plurality of strings 162.

Each of the one or more plectrum 163 is further defined with a first outer dimension 122. Each of the one or more coins 164 is further defined with a second outer dimension 124.

The hand grip 101 is a grip. The hand grip 101 is a solid semi-rigid structure with an elastic nature. The hand grip 101 has a form factor that allows the hand grip 101 to be grasped.

In the first potential embodiment of the disclosure, the hand grip 101 is formed in a semi-cylindrical shape 111. The semi-cylindrical shape 111 of the hand grip 101 is preferred.

Each of the one or more plectrum slots 102 is a negative space formed in the hand grip 101. Each of the one or more plectrum slots 102 is further defined with a first inner dimension 121. The negative space of each of the one or more plectrum slots 102 is the shape of a rectangular block. In its relaxed shape, the first inner dimension 121 is less than the first outer dimension 122 of each of the one or more plectrum 163 such that when a plectrum selected from the one or more plectrum 163 is inserted into a plectrum slot selected from the one or more plectrum slots 102, the selected plectrum slot is deformed.

Specifically, when the selected plectrum inserts into a plectrum slot selected from the one or more plectrum slots 102 the selected plectrum slot deforms. The elasticity of the hand grip 101 creates a first displacing force that opposes the displacement created by insertion of the selected plectrum into the selected plectrum slot. The first displacing force places an opposing force on the selected plectrum in the direction that returns the selected plectrum slot to its relaxed shape. This spring like action produces a clamping force that holds the selected plectrum securely within selected plectrum slot.

In the first potential embodiment of the disclosure, each of the one or more plectrum slots 102 is identical.

Each of the one or more reverb slots 103 is a negative space formed in the hand grip 101. Each of the one or more reverb slots 103 is further defined with a second inner dimension 123. The negative space of each of the one or more reverb slots 103 is the shape of a rectangular block. In its relaxed shape, the second inner dimension 123 is less than the second outer dimension 124 of each of the one or more coins 164 such that when a coin selected from the one or more coins 164 is inserted into a reverb slot selected from the one or more reverb slots 103 the selected reverb slot is deformed.

Specifically, when the selected coin inserts into a reverb slot selected from the one or more reverb slots 103 the selected reverb slot deforms. The elasticity of the hand grip 101 creates a second displacing force that opposes the displacement created by insertion of the selected coin into the selected reverb slot. The second displacing force places an opposing force on the selected coin in the direction that returns the selected reverb slot to its relaxed shape. This spring like action produces a clamping force that holds the selected coin securely within selected reverb slot.

In the first potential embodiment of the disclosure, each of the one or more reverb slots 103 is identical. The one or more reverb slots 103 are located on the hand grip 101 at a position distal from the one or more plectrum slots 102.

To use the invention 100 for plucking one or more strings selected from the plurality of strings 162 each of the one or more plectrum 163 are loaded into the one or more plectrum slots 102. As shown most clearly in FIG. 7, to pluck the plurality of strings 162 simultaneously with a plurality of plectrum selected from the one or more plectrum 163, the hand grip 101 is held in front of the plurality of strings 162 such that the one or more plectrum slots 102 run parallel to the plurality of strings 162. The hand grip 101 is then moved in a direction perpendicular to the plurality of strings 162.

Figure 9:
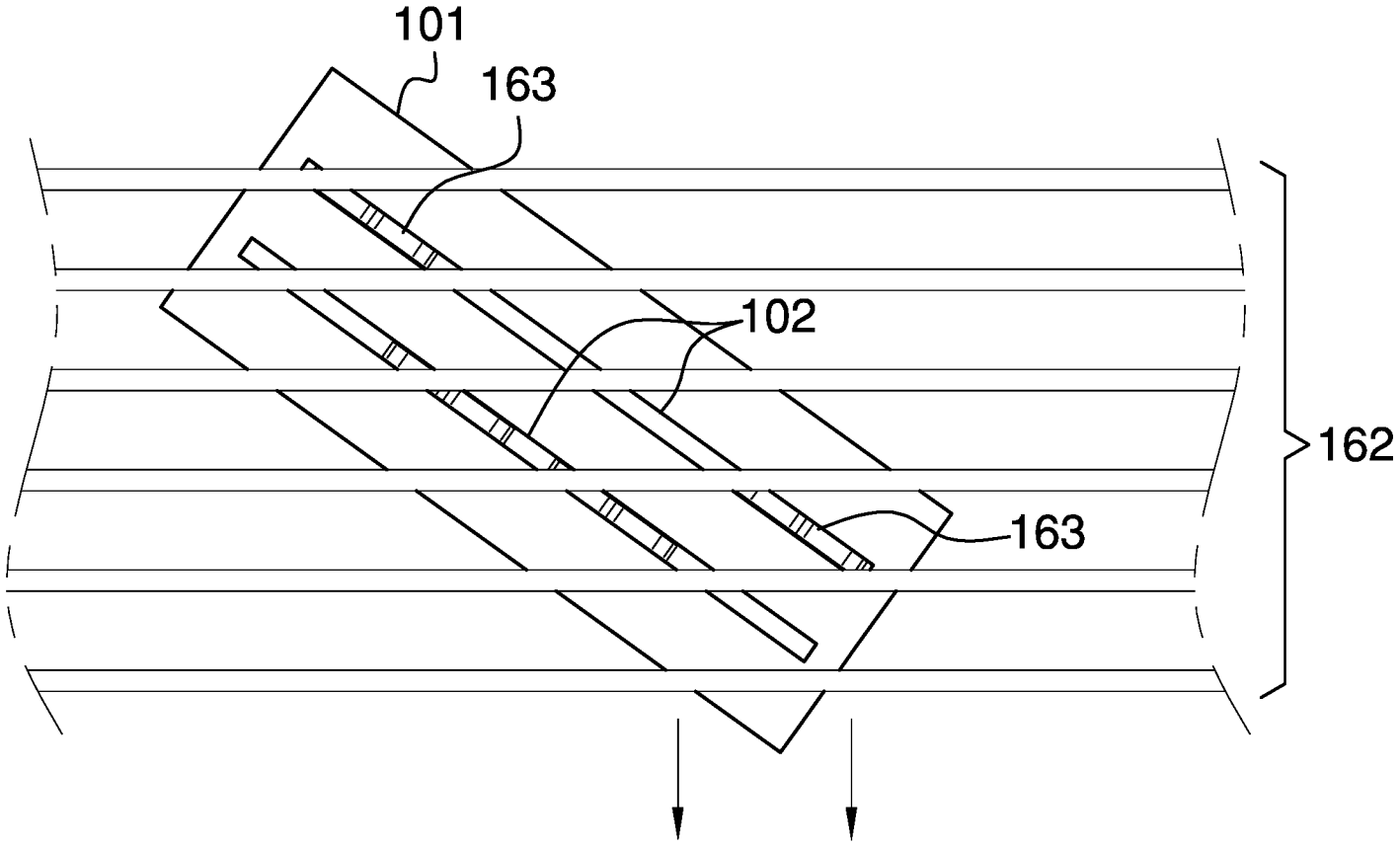
FIG. 9 is a detail view of an embodiment of the disclosure.
Figure 10:
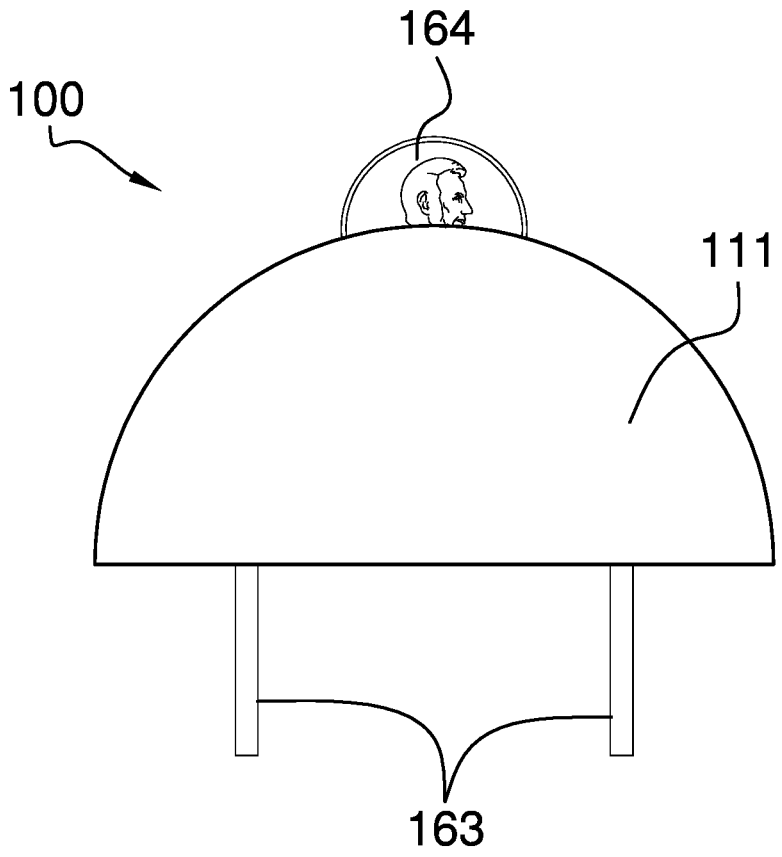
FIG. 10 is a detail view of an embodiment of the disclosure.

As shown most clearly in FIG. 9, to simultaneously pluck each of two or more strings selected from the plurality of strings 162 with a plectrum selected from the one or more plectrum 163, the hand grip 101 is held in front of the plurality of strings 162 such that the one or more plectrum slots 102 forms an angle relative to the plurality of strings 162. The hand grip 101 is then moved in a direction perpendicular to the plurality of strings 162.

Figure 8:
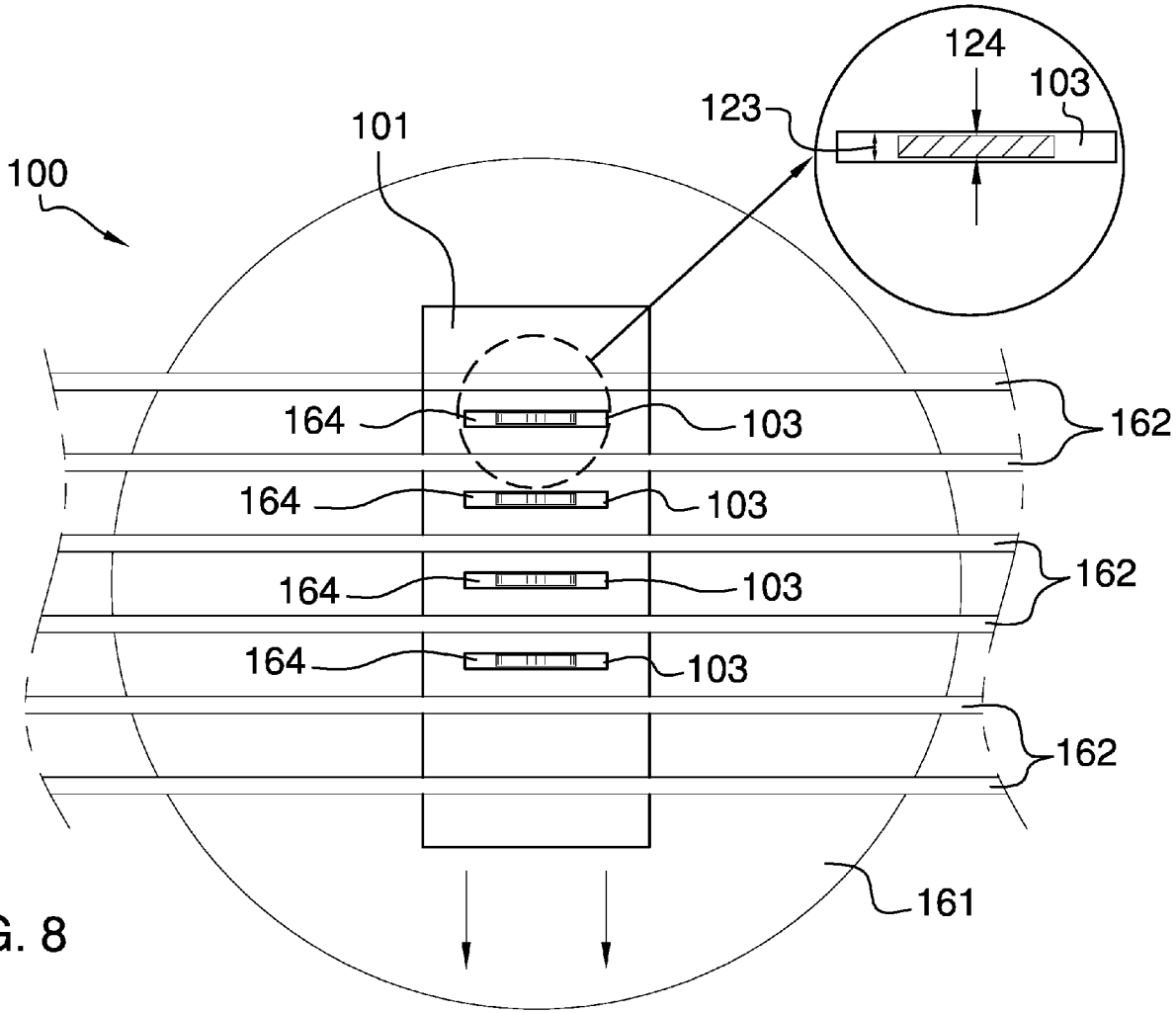
FIG. 8 is a detail view of an embodiment of the disclosure.

As shown most clearly in FIG. 8, to use the invention 100 to reverberate one or more strings selected from the plurality of strings 162 each of the one or more coins 164 are loaded into the one or more reverb slots 103. The ridge of each of the one or more coins 164 is placed against a string selected from the plurality of strings 162 and the hand grip 101 is moved in the direction parallel to the plurality of strings 162.

The following definitions were used in this disclosure:

Bass Guitar: As used in this disclosure, the bass guitar is a stringed musical instrument having a flat backed body, a neck and four strings that are played by plucking with the fingers or a pick. The bass guitar is tuned the same as a double bass instrument and can have a fretted fingerboard or an unfretted fingerboard. A bass guitar is usually electrically amplified but can be acoustically amplified. This definition is intended to match the common usage of the term.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Elastic: As used in this disclosure, an elastic is a material or object that deforms when a force is applied to it and that is able to return to its relaxed shape after the force is removed. A material that exhibits these qualities is also referred to as an elastomeric material.

Form Factor: As used in this disclosure, the term form factor refers to the size and shape of an object.

Grip: As used in this disclosure, a grip is an accommodation formed within an object that allows the object to be grasped or manipulated by a hand.

Guitar: As used in this disclosure, a guitar refers to a traditional guitar or a bass guitar.

Horizontal Segment: As used in this disclosure, a horizontal segment refers to a prism or cylinder that is truncated by a single plane that is parallel to or contains the center axis of the prism or cylinder.

Inner Dimension: As used in this disclosure, the term inner dimension describes the span from a first inside or interior surface of a container to a second inside or interior surface of a container. The term is used in much the same way that a plumber would refer to the inner diameter of a pipe.

Negative Space: As used in this disclosure, negative space is a method of defining an object through the use of open or empty space as the definition of the object itself, or, through the use of open or empty space to describe the boundaries of an object.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Plectrum: As used in this disclosure, a plectrum is a flat semi-rigid plate structure with an elastic nature that is used to pluck the strings of a stringed musical instrument. A guitar pick is an example of a plectrum.

Pluck: As used in this disclosure, to pluck means to rapidly move an object from its original position. Pluck is often used in reference to initiating the vibration of strings in a stringed musical instrument.

Rectangular Block: As used in this disclosure, a rectangular block refers to a three-dimensional structure comprising six rectangular surfaces formed at right angles. Within this disclosure, a rectangular block may further comprise rounded edges and corners.

Relaxed Shape: As used in this disclosure, a structure is considered to be in its relaxed state when no shear, strain, or torsional forces are applied to the structure.

Reverberation: As used in this disclosure, a reverberation refers to a phase shift an audible sound created by the combination of the original sound and a reflection of the original sound off of a surface. Reverberation refers to the original sound and the reflected sound as heard from a single location. When the phase difference between the original sound and the reflected sound is greater than 20 milliseconds, the reverberation will sound like an echo. When the phase difference between the original sound and the reflected sound is greater than 20 milliseconds, human ears are not able to separate the original sound and the reflected sound and merges the two sounds into a single distinctive sound.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Semi-Cylinder: As used in this disclosure, a semi-cylinder is half of a cylinder that is horizontally segmented such that the center axis of the cylinder is fully contained within the dividing plane.

Semi-Rigid Structure: As used in this disclosure, a semi-rigid structure is a solid structure that is stiff but not wholly inflexible and that will deform under force before breaking. A semi-rigid structure may or may not behave elastically in that a semi-rigid structure need not return to a relaxed shape.

Slot: As used in this disclosure, a slot is a long narrow groove or aperture formed in an object.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

Traditional Guitar: As used in this disclosure, a traditional guitar is a stringed musical instrument generally having a flat back, a neck, a fretted fingerboard, and either 6 or 12 strings that are played by strumming or plucking with the fingers or a pick. A traditional guitar can be acoustically or electrically amplified. This definition is intended to match the common usage of the term guitar.

Truncated: As used in this disclosure, a geometric object is truncated when an apex, vertex, or end is cut off by a line or plane.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A pick holder comprising a hand grip, one or more plectrum slots, and one or more reverb slots;

wherein the one or more plectrum slots and the one or more reverb slots are formed within the hand grip;

wherein the pick holder is configured for use with a stringed musical instrument;

wherein the stringed musical instrument further comprises a plurality of strings;

wherein the pick holder is configured for use with one or more plectrum;

wherein the pick holder is configured for use with one or more coins;

wherein the hand grip holds and controls the one or more plectrum;

wherein the hand grip holds and controls the one or more coins;

wherein each of the one or more plectrum is further defined with a first outer dimension;

wherein each of the one or more coins is further defined with a second outer dimension.

2. The pick holder according to claim 1
wherein the pick holder enables the simultaneous plucking of two or more strings selected from the plurality of strings by two or more plectrum selected from the one or more plectrum;
wherein the pick holder enables the simultaneous plucking of a single string selected from the plurality of strings by two or more plectrum selected from the one or more plectrum;
wherein the pick holder enables the simultaneous plucking of two or more strings by two or more coins selected from the one or more coins.

3. The pick holder according to claim 2 wherein the hand grip is a solid semi-rigid structure with an elastic nature.

4. The pick holder according to claim 3 wherein the hand grip has a form factor that allows the hand grip to be grasped.

5. The pick holder according to claim 4 wherein the hand grip is formed in a semi-cylindrical shape.

6. The pick holder according to claim 5
wherein each of the one or more plectrum slots is a negative space;
wherein each of the one or more plectrum slots is further defined with a first inner dimension;
wherein the negative space of each of the one or more plectrum slots is the shape of a rectangular block.

7. The pick holder according to claim 6 wherein a plectrum selected from the one or more plectrum inserts into a plectrum slot selected from the one or more plectrum slots the selected plectrum slot.

8. The pick holder according to claim 7 wherein the first inner dimension is less than the first outer dimension of each of the one or more plectrum such that when a plectrum selected from the one or more plectrum is inserted into a plectrum slot selected from the one or more plectrum slots, the selected plectrum slot is deformed.

9. The pick holder according to claim 8 wherein the elasticity of the hand grip creates a first displacing force that holds the selected plectrum securely within selected plectrum slot.

10. The pick holder according to claim 9 wherein each of the one or more plectrum slots is identical.

11. The pick holder according to claim 10
wherein each of the one or more reverb slots is a negative space;
wherein each of the one or more reverb slots is further defined with a second inner dimension;
wherein the negative space of each of the one or more reverb slots is the shape of a rectangular block.

12. The pick holder according to claim 11 wherein a coin selected from the one or more coins inserts into a reverb slot selected from the one or more reverb slots the selected reverb slot.

13. The pick holder according to claim 12 wherein the second inner dimension is less than the second outer dimension of each of the one or more coins such that when a coin selected from the one or more coins is inserted into a reverb slot selected from the one or more reverb slots, the selected reverb slot is deformed.

14. The pick holder according to claim 13 wherein the elasticity of the hand grip creates a second displacing force that holds the selected coin securely within selected reverb slot.

15. The pick holder according to claim 14 wherein each of the one or more reverb slots is identical.

16. The pick holder according to claim 15 wherein the one or more reverb slots are located on the hand grip at a position distal from the one or more plectrum slots.

17. The pick holder according to claim 2
wherein each of the one or more reverb slots is a negative space;
wherein each of the one or more reverb slots is further defined with a second inner dimension;
wherein the negative space of each of the one or more reverb slots is the shape of a rectangular block;
wherein a coin selected from the one or more coins inserts into a reverb slot selected from the one or more reverb slots the selected reverb slot;
wherein the second inner dimension is less than the second outer dimension of each of the one or more coins such that when a coin selected from the one or more coins is inserted into a reverb slot selected from the one or more reverb slots, the selected reverb slot is deformed;
wherein the elasticity of the hand grip creates a second displacing force that holds the selected coin securely within selected reverb slot.

18. The pick holder according to claim 17
wherein each of the one or more plectrum slots is a negative space;
wherein each of the one or more plectrum slots is further defined with a first inner dimension;
wherein the negative space of each of the one or more plectrum slots is the shape of a rectangular block;
wherein a plectrum selected from the one or more plectrum inserts into a plectrum slot selected from the one or more plectrum slots the selected plectrum slot;
wherein the first inner dimension is less than the first outer dimension of each of the one or more plectrum such that when a plectrum selected from the one or more plectrum is inserted into a plectrum slot selected from the one or more plectrum slots, the selected plectrum slot is deformed;
wherein the elasticity of the hand grip creates a first displacing force that holds the selected plectrum securely within selected plectrum slot.

19. The pick holder according to claim 18
wherein each of the one or more plectrum slots is identical;
wherein each of the one or more reverb slots is identical;
wherein the one or more reverb slots are located on the hand grip at a position distal from the one or more plectrum slots.

20. The pick holder according to claim 19
wherein the hand grip is a solid semi-rigid structure with an elastic nature;
wherein the hand grip has a form factor that allows the hand grip to be grasped;
wherein the hand grip is formed in a semi-cylindrical shape.

* * * * *